United States Patent [19]

Dukas

[11] 4,104,872

[45] Aug. 8, 1978

[54] ADJUSTABLE EXPANSION BAND FOR WRISTWATCH

[75] Inventor: Sander G. Dukas, Kowloon, Hong Kong

[73] Assignee: Timex Corporation, Waterbury, Conn.

[21] Appl. No.: 796,300

[22] Filed: May 12, 1977

[51] Int. Cl.[2] ..... F16G 13/24; A44C 5/08

[52] U.S. Cl. ..... 59/79 R

[58] Field of Search ..... 59/79 R; 63/5 R; 224/4 B, 4 D, 4 H

[56] References Cited

U.S. PATENT DOCUMENTS

| | | | |
|---|---|---|---|
| 3,140,581 | 7/1964 | Hauser | 59/79 R |
| 3,416,305 | 12/1968 | Rieth | 59/79 R |
| 3,543,507 | 12/1970 | Vanover | 59/79 R |
| 4,008,632 | 2/1977 | Denney | 59/79 R |

FOREIGN PATENT DOCUMENTS

| | | | |
|---|---|---|---|
| 662,400 | 4/1963 | Canada | 59/79 R |
| 1,173,714 | 12/1960 | Fed. Rep. of Germany | 59/79 R |

*Primary Examiner*—C.W. Lanham
*Assistant Examiner*—Gene P. Crosby
*Attorney, Agent, or Firm*—William C. Crutcher

[57] ABSTRACT

An adjustable expansion band for a wristwatch of the type having two rows of overlapping links, having clips connecting alternating links between rows, and containing spring members within the links. The construction utilizes U-shaped clip members having asymmetrical legs and selectively engaging the springs which are held in slideable spring retainers inside the links. Adjacent expansion band sections can be disengaged by sliding the spring retainers to the unlocked positions.

4 Claims, 11 Drawing Figures

ADJUSTABLE EXPANSION BAND FOR WRISTWATCH

BACKGROUND OF THE INVENTION

Briefly stated, this invention relates to an improvement in expansion bands of a known type employing two rows of overlapping links, clip members connecting alternate links between rows, and spring members contained within the links together so that the links can be stretched apart and returned by the springs. Expansion bands of this type are well known in the art and described for example, in U.S. Pat. No. 2,689,450 issued to K. E. Stiegele on Sept. 21, 1954, U.S. Pat. No. 3,307,348 - Vanover issued Mar. 7, 1967, and U.S. Pat. No. 3,994,126 issued to K. A. Rieth of Nov. 30, 1976. Although this type of expansion band is very useful and economical to produce, nevertheless it becomes desirable to have an easy means for breaking into the expansion band at some point along its length, either for the purpose of making adjustments in overall length or for connecting or disconnecting sub-assemblies for manufacturing convenience. One construction for disconnecting sections of the band at any desired spot is shown in British Pat. No. 801,850, Complete Specification published Sept. 24, 1955 in the name of Rodi and Wienenberger A.G., which employs special spring members extending into opposite link rows and employs links of special shape. Another construction in a non-expansion type link bracelet utilizes a slideable member contained within the link which may be manipulated by a tool to disconnect the links, shown in German Offenlegungschrift No. 1,086,074 in the name of Albert Heinz.

Another construction for providing adjustment to an expansion band of the foregoing type is seen in U.S. Pat. No. 3,416,305 issued Dec. 17, 1968 to K. A. Rieth. This patent employs a special shape spring member with a section extending from one row of links and to a link in the other row, this catch member being actuated so as to disengage the links with a longitudinal sliding motion. The remainder of the watch band sections are of the conventional U-shaped clip and spring type, and consequently it is necessary to employ two different types of sections in the band, with the appearance being slightly different.

It would be desirable to have an adjustable expansion band utilizing the simple and widely accepted U-shaped clip and leaf-spring construction, with provision for disconnecting the sections and reattaching them at desired locations.

Accordingly, one object of the present invention is to provide an improvement in a known type of expansion band which permits engagement or disengagement at selected locations along the band.

Another object of the invention is to provide an economical and improved construction for an adjustable expansion band for a wristwatch.

DRAWINGS

The invention, both as to organization and method of practice, together with further objects and advantages thereof, will best be understood by reference to the following description, taken in connection with the accompanying drawings, in which.

Figure 2:
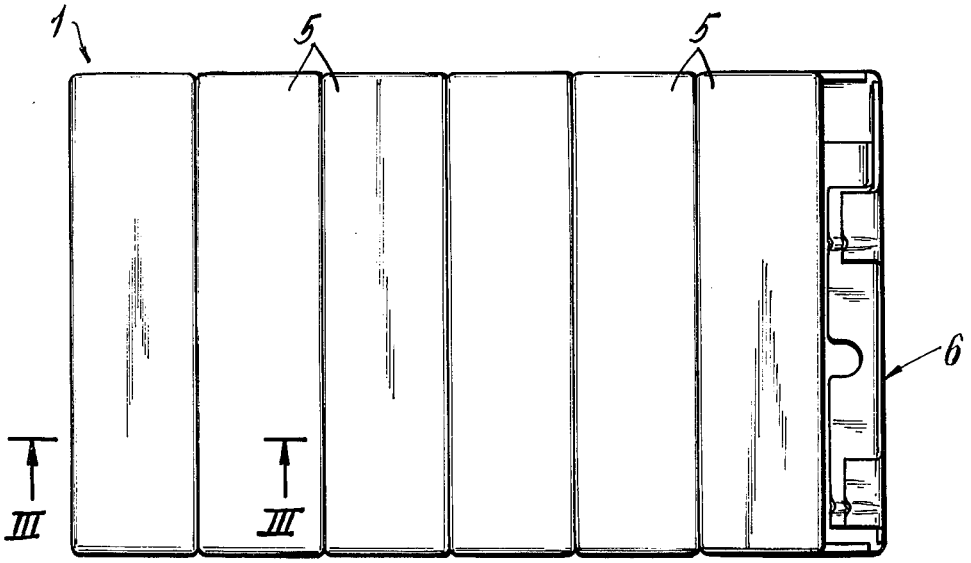
FIG. 2 is a plan view of an expansion band section.
Figure 3:
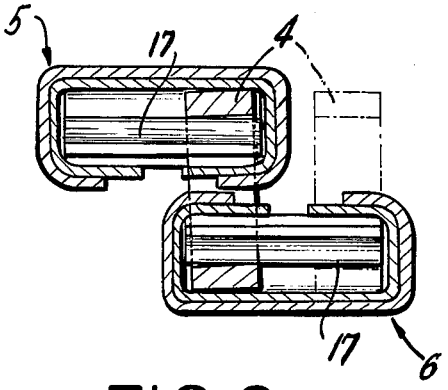
Figure 4:
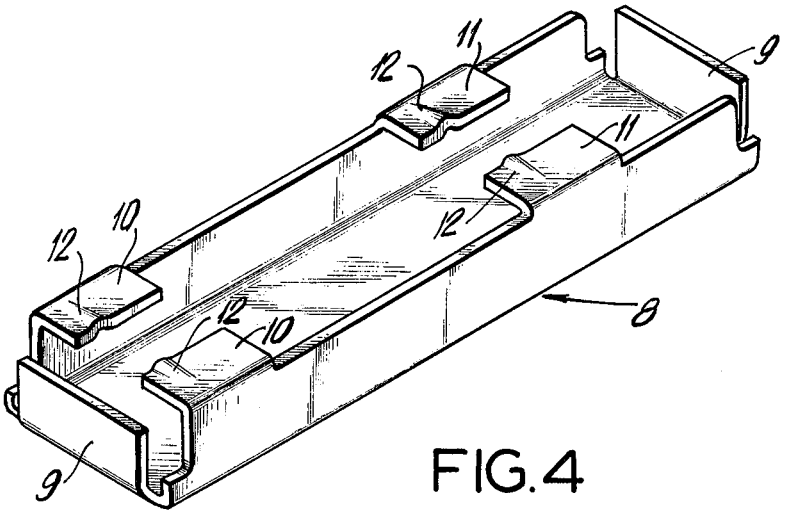
Figure 5:
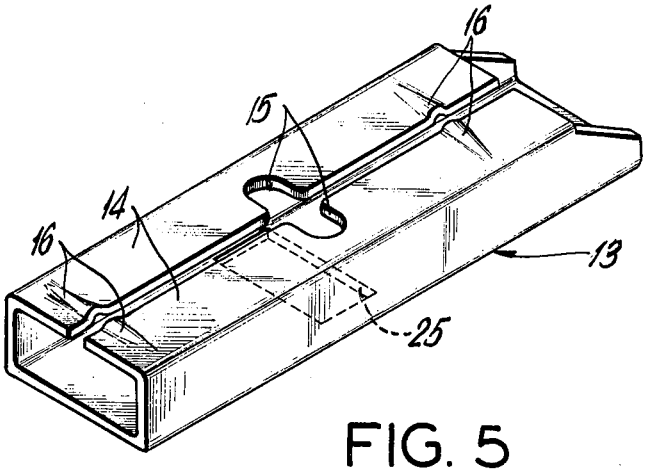
Figure 6:
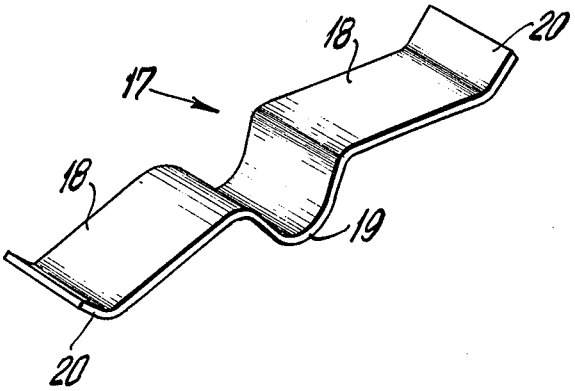
Figure 7:
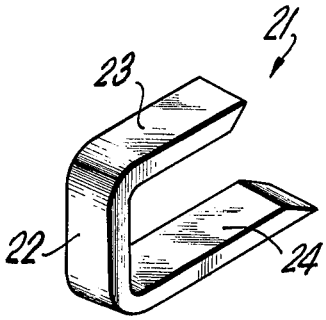
Figure 8A:
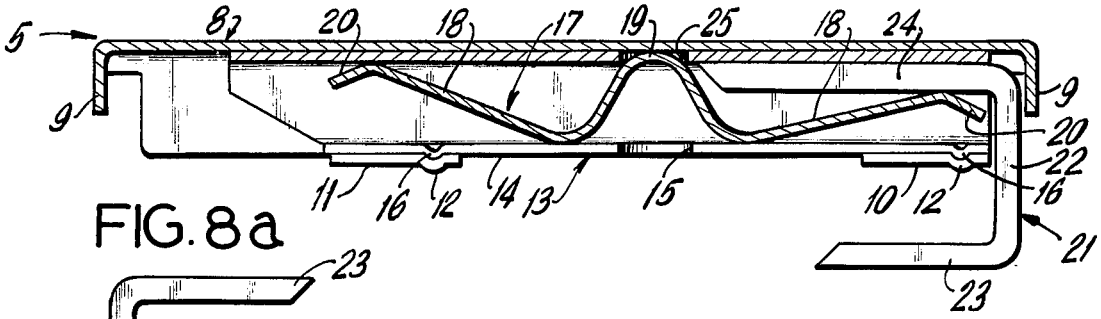
Figure 8B:
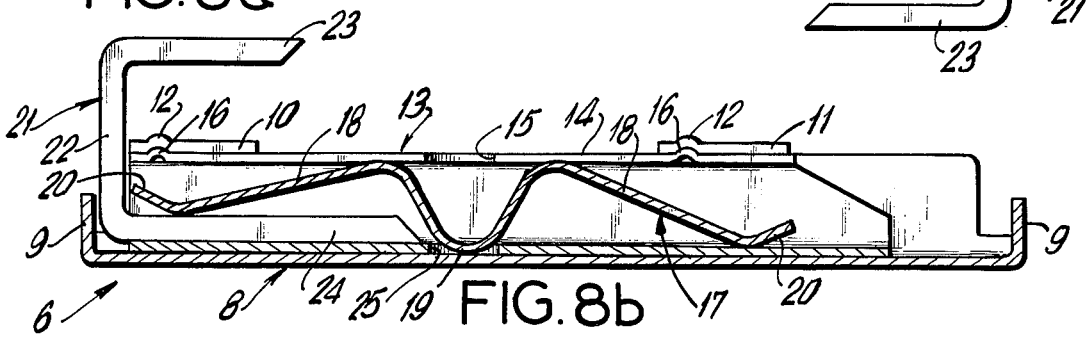

FIG. 3 is an enlarged end elevation view of a pair of connected links, taken along III-III of FIG. 2, FIG. 4 is a perspective view of one of the expansion band links, FIG. 5 is a perspective view of the spring retainer of the present invention, FIG. 6 is a perspective view of the spring member of the present invention, FIG. 7 is a perspective view of the preferred clip member of the present invention, FIGS. 8a and 8b are juxtaposed upper and lower link assemblies positioned for engagement with one another, with spring retaining means in unlocked position.

Figure 9:
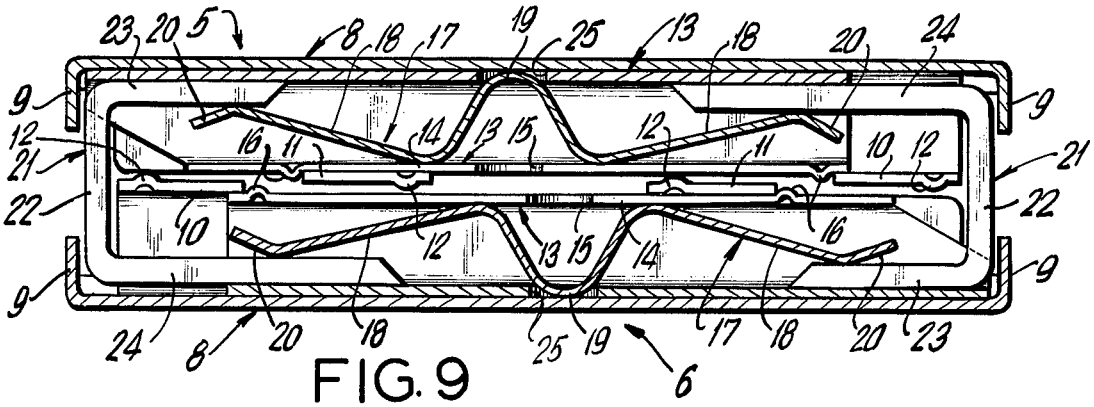
Figure 10:
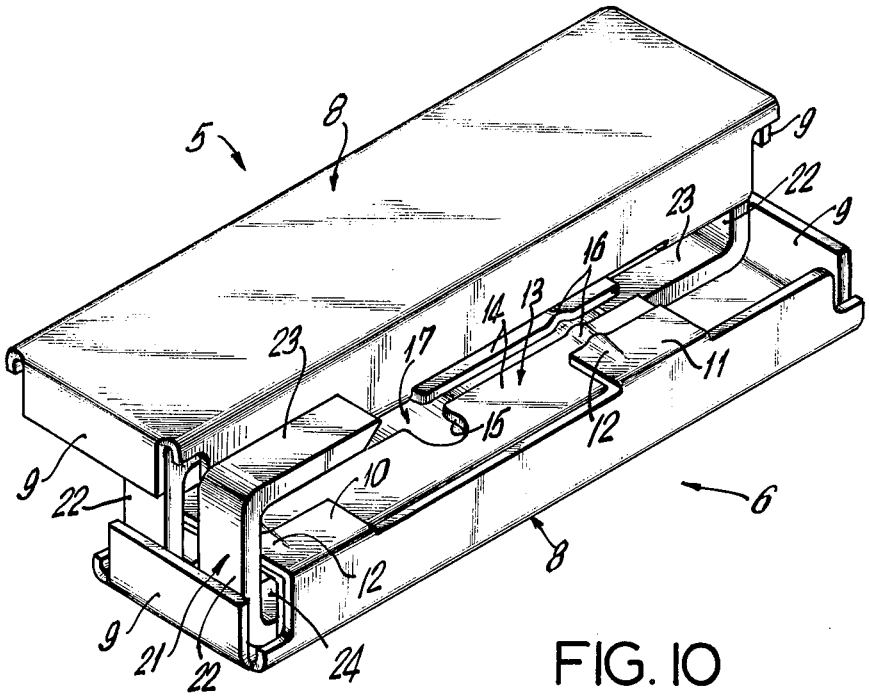

FIG. 9 shows the upper and lower link assemblies in engaged and locked position, FIG. 10 is a partial perspective view of engaged upper and lower link assemblies.

SUMMARY OF THE INVENTION

Briefly stated, the invention is practiced by providing the improvement in an expansion band of the type employing two rows of overlapping links, clip members connecting alternate links between rows, and spring members disposed within the links, said improvement comprising retainer means for the spring members permitting movement between locked and unlocked positions, and clip members having a pair of asymmetrical legs cooperating with the springs when they are in a locked position and permitting disengagement of the links when the springs are in an unlocked position. In its preferred form, the clip members have unequal leg lengths and the spring retainers are longitudinally slideable within the links.

DESCRIPTION OF THE PREFERRED EMBODIMENT

Figure 1:
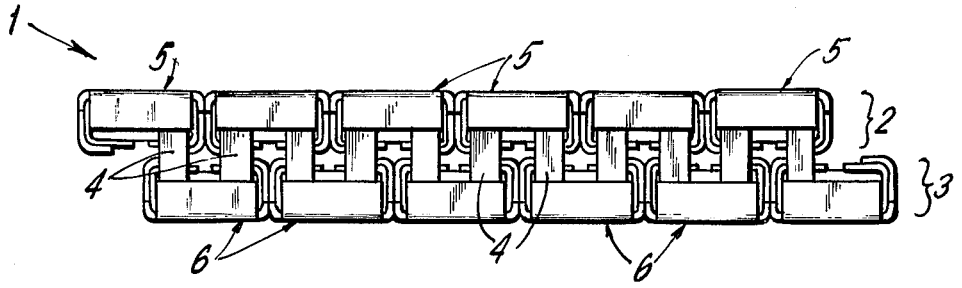
FIG. 1 is an end elevation view of an expansion band section of the type using the present invention.

Referring now to FIG. 1 of the drawing, the expansion band, shown generally at 1 includes a first or upper row of links 2 and a second or lower row of links 3. The links are arranged in overlapping fashion and employ clip members for connecting alternate links between rows. The upper row 2 is made up of individual upper link assemblies 5 and similarly the lower row 3 is made up of lower link assemblies 6. Very often, the upper link assemblies 5 have decorative covers, while the lower link assemblies 6 simply have turned up tabs on the end to retain the clip members, these details not being material to the present invention.

FIG. 6 shows the plan view of the upper link assemblies 5 and, FIG. 3 which is an enlarged section view shows the typical and well-known means of construction whereby U-shaped clips 4 interconnect the upper and lower assemblies, whereas leaf-spring members contained within the links serve to press the legs of the clips against the walls of the links so as to provide a spring return action when the band is stretched. The foregoing construction is known in the art.

Referring to the improvements which comprise the present invention, a typical link 8 is shown in FIG. 4, which may be identical for both the upper and lower link assemblies 5,6 respectively. Link 8 is a rectangular sheet metal enclosure with turned up end tabs 9 opposite ends and open on one longitudinal side thereof except for oppositely directed tabs 10 on one end thereof and oppositely directed tabs 11 spaced from the opposite end thereof. Crimped portions 12 on tabs 10 and 11 serve to lock the spring retainers in engaged or in disengaged positions as will be further described.

Shown in FIG. 5 is a spring retainer 13, which may be identical in the upper and lower link assemblies 5,6 respectively. Spring retainer 13 is an open-ended rectangular sheet metal enclosure which is slightly smaller in its width and height so that it will fit inside a link 8, and shorter than link 8 so that it can slide longitudinally therein between engaged and disengaged positions. The retainer 13 has folded over sections 14 extending toward one another and adding oppositely directed apertures 15 and crimped portions 16 spaced so as to register with crimped portions 12 in the links 8.

Shown in FIG. 6 are the leaf spring members 17 which include oppositely extending spring legs 18 on either side of a bowed portion 19 having turned up ends 20.

Referring to FIG. 7, the clip members are shown as 21 to be generally U-shaped with a base section 22 and legs 23, 24, of unequal length. The aforementioned spring members 17 and clip members 21 are preferably all interchangeable and may be used either in upper or lower link assemblies or at opposite ends of the links as will be evident from the description which follows.

Referring to FIG. 8A and FIG. 8B of the drawing, and upper link assembly 5 and a lower link assembly 6 are shown separated from one another and with the spring retainers in the unlocked position. The spring retainer 13 in the upper assembly is moved all the way to the right (be means of using a tool or probe in hole 15.) Similarly the lower retainer 13 is moved all the way to the left.

The spring members 17 are disposed within the retainers, and held in position by the bow portion 19 resting in a slot 25 in the bottom wall (see FIG. 5). The clip members 21 are arranged with the long legs 24 held in place by one end of the spring and the short legs 23 free to engage or disengage the opposing link assemblies to the position of the spring retainers.

Referring now to FIG. 9 of the drawing, the upper and lower link assemblies 5,6 are shown in a locked and engaged position. The upper spring retainer 13 has been moved longitudinally to the left so that the end of the spring arm 18 rests on the short arm 23 of the left-hand clip. The lower retainer 13 has been similarly moved to the right so that the right hand spring arm 18 also rests on the short arm 23 of the clip. The retainers are locked in this position, since the crimped sections 16, 12 no longer are in registry, but now the crimped portion 16 is positioned against the tab members 10,11. When the assemblies are engaged in locked as shown in FIG. 9, the spring members 17 cooperate with opposite ends of clip members 21 in the same fashion as a conventional expansion band of this type.

Reference to the perspective exploded view of FIG. 10 further illustrates the manner in which the parts are assembled.

OPERATION

In operation, when the parts are assembled and it is wished to disengage them, it is only necessary to spread the link assemblies slightly to expose the slots 15 and to utilize a probe or pointed instrument to slide the spring retainers 13 longitudinally within the links. The upper spring retainer is slid in one direction and the lower spring retainer in the opposite direction, whereupon the upper and lower link assemblies, and thus the attached expansion band sections, may be disengaged since the parts will now all pass by the short legs 23 of the clip members. Reengagement of the sections or removal of one or more links is accomplished in the same manner. The expansion band may be entirely composed of links as described, or the spring retainers, special springs and clips omitted and conventional springs and clips substituted, the appearance of the expansion band to all intents and purposes being entirely the same whether or not the special parts are employed.

While there has been described what is considered at present to be the preferred embodiment of the invention, other modifications will occur to those skilled in the art. It should be apparent that various types of asymmetric clip members and means for moving the spring members to avoid same in a locked and unlocked position can be accomplished within the scope of the present invention.

I claim:

1. In an expansion band of the type having two rows of overlapping links, clip members connecting alternating links between rows, and spring members disposed within said links, the improvement comprising:

a pair of asymmetrical legs on each of said clip members disposed in the ends of alternating links, said clips arranged on opposite ends of the links, and spring retaining means disposed within said links arranged to hold said spring members and adapted to be movable between locked and unlocked positions, said spring members each having spring arms cooperating with both of the legs of opposite clip members in the locked position and cooperating with only one leg of a clip member in the unlocked position.

2. The combination according to claim 1 wherein said clip members have legs of unequal length, arranged with the short leg of one clip and the long leg of the oppositely directed clip facing one another in the same link and wherein said spring retaining means are longitudinally slideable within said links.

3. The combination according to claim 1, wherein said spring retaining means are longitudinally slideable in the links, and wherein said spring members are disposed within the retainers.

4. The combination according to claim 1, wherein said clip members are U-shaped with legs of unequal length and wherein the spring members are leaf-springs having opposite spring arms arranged to bear on both clip members in the locked position and arranged to bear on only one clip member in the unlocked position.

* * * * *